US011211023B2

(12) United States Patent
Fu et al.

(10) Patent No.: US 11,211,023 B2
(45) Date of Patent: Dec. 28, 2021

(54) DISPLAY METHOD OF DISPLAY DEVICE AND DISPLAY DEVICE

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Siqing Fu, Beijing (CN); Xinghong Liu, Beijing (CN); Xu Lu, Beijing (CN); Shuai Hou, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 538 days.

(21) Appl. No.: 16/099,956

(22) PCT Filed: Mar. 13, 2018

(86) PCT No.: PCT/CN2018/078868
§ 371 (c)(1),
(2) Date: Nov. 8, 2018

(87) PCT Pub. No.: WO2019/024503
PCT Pub. Date: Feb. 7, 2019

(65) Prior Publication Data

US 2021/0225315 A1 Jul. 22, 2021

(30) Foreign Application Priority Data

Jul. 31, 2017 (CN) ..... 201710641780.1

(51) Int. Cl.
*G09G 3/36* (2006.01)
*G09G 3/00* (2006.01)

(52) U.S. Cl.
CPC ..... *G09G 3/3688* (2013.01); *G09G 3/006* (2013.01); *G09G 2310/08* (2013.01); *G09G 2330/06* (2013.01)

(58) Field of Classification Search
CPC ..... G09G 3/3688; G09G 3/006; G09G 5/003; G09G 5/005; G09G 2310/08;
(Continued)

(56) References Cited

U.S. PATENT DOCUMENTS 7,982,726 B2 * 7/2011 Kim ..... H04N 17/04 345/204
8,823,689 B2 * 9/2014 Jang ..... G09G 5/363 345/204

(Continued)

FOREIGN PATENT DOCUMENTS

CN 101409057 A 4/2009
CN 101645245 A 2/2010

(Continued)

OTHER PUBLICATIONS

International Search Report and Written Opinion dated May 30, 2018; PCT/CN2018/078868.

(Continued)

*Primary Examiner* — Tom V Sheng

(57) ABSTRACT

A display method of a display device and the display device are provided. The display method includes: acquiring an abnormality of signal of a front-end system; outputting a normal timing signal and a specified data signal to a display panel, until an end of a current frame.

17 Claims, 4 Drawing Sheets

(58) Field of Classification Search
CPC ..... G09G 2310/0243; G09G 2310/061; G09G 2330/06
USPC ..... 345/87
See application file for complete search history.

(56) References Cited

U.S. PATENT DOCUMENTS

| | | | | |
|---|---|---|---|---|
| 9,582,850 | B2 * | 2/2017 | Chou | G06T 1/60 |
| 2002/0109786 | A1 * | 8/2002 | Chae | G09G 5/18 348/500 |
| 2004/0113907 | A1 * | 6/2004 | Lee | G09G 3/3648 345/211 |
| 2009/0096769 | A1 * | 4/2009 | Kim | G09G 3/2096 345/204 |
| 2010/0033453 | A1 | 2/2010 | Park et al. | |
| 2011/0096079 | A1 * | 4/2011 | Carter | G06F 1/3203 345/520 |
| 2012/0147195 | A1 | 6/2012 | Jang et al. | |
| 2013/0215090 | A1 * | 8/2013 | Kim | G09G 3/36 345/204 |
| 2015/0130822 | A1 * | 5/2015 | Lee | G09G 3/20 345/520 |

FOREIGN PATENT DOCUMENTS

| | | | |
|---|---|---|---|
| CN | 102543015 | A | 7/2012 |
| CN | 103258511 | A | 8/2013 |
| CN | 106548761 | A | 3/2017 |
| CN | 107240381 | A | 10/2017 |

OTHER PUBLICATIONS

The First Chinese Office Action dated Jan. 30, 2019; Appln. No. 201710641780.1.

* cited by examiner

DISPLAY METHOD OF DISPLAY DEVICE AND DISPLAY DEVICE

The present application claims priority of Chinese Patent Application No. 201710641780.1 filed on Jul. 31, 2017, the disclosure of which is incorporated herein by reference in its entirety as part of the present application.

TECHNICAL FIELD

Embodiments of the present disclosure relate to a display method of a display device and a display device.

BACKGROUND

In a case where a liquid crystal display device is started or subjected to external interference, for example, electrostatic discharge (ESD) and built-in self test (BIST), etc., a front-end system signal transmission abnormality (for example, transmission of a non-whole-frame signal, a signal frequency abnormality, etc.) often occurs. In a case where a timing controller (TCON) finds out the front-end signal abnormality, it usually immediately stops current display and enters a fail mode, and at this time, a liquid crystal panel exhibits a timing disorder due to mode switching of the timing controller, resulting in display abnormality, and in some cases, it is even impossible to resume normal display.

SUMMARY

According to embodiments of the disclosure, a display method of a display device is provided. The display device comprises a display panel. The method comprises: acquiring an abnormality of a signal of a front-end system; outputting a normal timing signal and a specified data signal to the display panel, until an end of a current frame. The current frame is a frame being displayed when the abnormality of the signal of the front-end system is acquired, and the normal timing signal is a timing signal of the current frame in a case where the abnormality does not occur to the signal of the front-end system.

For example, the display method comprises: in a case where a signal indicating that the signal of the front-end system returns to normal is received before the end of the current frame, continuing to output the normal timing signal and the specified data signal to the display panel until the end of the current frame.

For example, the display method comprises: outputting a timing signal and a data signal to the display panel in response to the signal of the front-end system after the end of the current frame.

For example, the display method comprises: in a case where a signal indicating that the signal of the front-end system returns to normal is not received after the end of the current frame, entering a fail mode.

For example, the display method comprises: after entering the fail mode, in a case where the signal indicating that the signal of the front-end system returns to normal is received, outputting a timing signal and a data signal to the display panel in response to the signal of the front-end system after an end of a frame being displayed when the signal indicating that the signal of the front-end system returns to normal is received.

For example, the display method comprises: outputting an original timing signal of a frame after the current frame and outputting a black picture data to the display panel, in the fail mode. The original timing signal of the frame after the current frame is a timing signal of the frame after the current frame in the case where the abnormality does not occur to the signal of the front-end system.

For example, the acquiring the abnormality of the signal of the front-end system includes: analyzing a data enable signal, to determine whether or not the signal of the front-end system is abnormal.

For example, the abnormality of the signal of the front-end system includes any one of cases where: as compared with a preset data enable signal, a frequency of the data enable signal is larger, the frequency of the data enable signal is smaller, a pulse width of the data enable signal is larger, the pulse width of the data enable signal is smaller, the data enable signal is missing, and the frequency of the data enable signal is unstable.

For example, the specified data signal is a last line of data before the abnormality of the signal of the front-end system is acquired or a black picture data.

For example, the display device comprises a control circuit for transmitting a signal to the display panel, the control circuit includes a timing controller, and the front-end system is a portion of the control circuit that is before the timing controller along a signal transmission direction.

According to embodiments of the disclosure, a display device is provided. The display device comprises a display panel and a control circuit for transmitting a signal to the display panel, the control circuit includes a timing controller and a data driver. The timing controller is configured to acquire an abnormality of a signal of a front-end system, and output a normal timing signal and controls the data driver to output a specified data signal to the display panel until an end of a current frame; the current frame is a frame being displayed when the abnormality of the signal of the front-end system is acquired, and the normal timing signal is a timing signal of the current frame in a case where the abnormality does not occur to the signal of the front-end system.

For example, in a case where a signal indicating that the signal of the front-end system returns to normal is received before the end of the current frame, the timing controller continues to output the normal timing signal and continues to control the data driver to output the specified data signal to the display panel until the end of the current frame.

For example, after the end of the current frame, the timing controller outputs a timing signal and controls the data driver to output a data signal to the display panel in response to the front-end system signal.

For example, in a case where a signal indicating that the signal of the front-end system returns to normal is not received after the end of the current frame, the timing controller controls the display panel to enter a fail mode.

For example, after the display panel enters the fail mode, in a case where the signal indicating that the signal of the front-end system returns to normal is received, the timing controller outputs a timing signal and controls the data driver to output a data signal to the display panel in response to the signal of the front-end system after an end of a frame being displayed when the signal indicating that the signal of the front-end system returns to normal is received.

For example, in the fail mode, the timing controller outputs an original timing signal of a frame after the current frame and controls the data driver to output a black picture data to the display panel; the original timing signal of the frame after the current frame is a timing signal of the frame after the current frame in the case where the abnormality does not occur to the signal of the front-end system.

For example, the timing controller acquires the abnormality of the signal of the front-end system by analyzing a data enable signal.

For example, the abnormality of the signal of the front-end system includes any one of cases where: as compared with a preset data enable signal, a frequency of the data enable signal is larger, the frequency of the data enable signal is smaller, a pulse width of the data enable signal is larger, the pulse width of the data enable signal is smaller, the data enable signal is missing, and the frequency of the data enable signal is unstable.

For example, the specified data signal is a last line of data before the abnormality of the signal of the front-end system is acquired or a black picture data.

For example, the front-end system being a portion of the control circuit that is before the timing controller along a signal transmission direction.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the present disclosure apparent, the technical solutions of the embodiment will be described in a clearly and fully understandable way in connection with the drawings. It is obvious that the described embodiments are just a part but not all of the embodiments of the present disclosure. Based on the described embodiments herein, those skilled in the art can obtain other embodiment(s), without any inventive work, which should be within the scope of the present disclosure.

Figure 1:
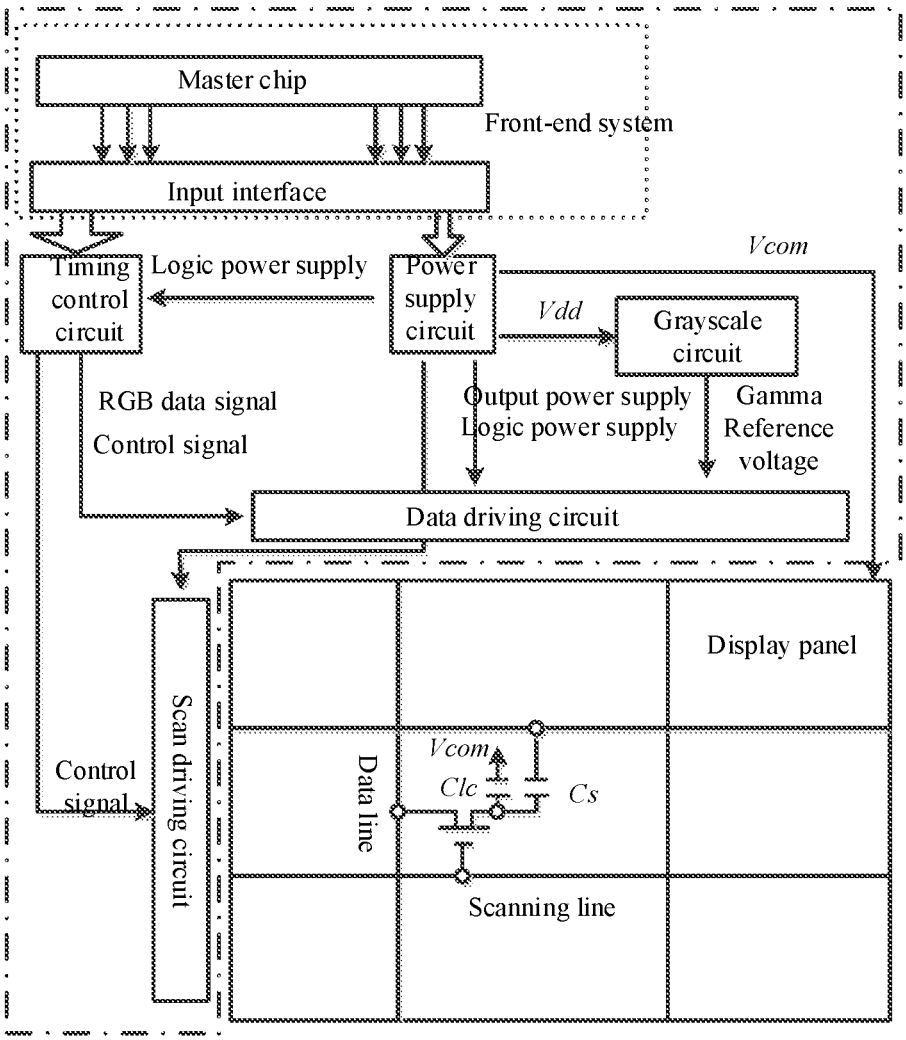
FIG. 1 is a schematic diagram of a circuit structure of a thin film transistor liquid crystal display device.

FIG. 1 shows a circuit structure of a thin film transistor liquid crystal display device. As shown in FIG. 1, a signal output from a master chip enters a timing controller (TCON) and a power supply circuit through an input interface, and in this case, a power signal is input to the power supply circuit, and a digital signal is input to the TCON. The digital signal input from the master chip to the TCON, in addition to RGB data and data sampling clock DCLK, further includes three control signals, which are respectively a data enable (DE) signal, an Hsync (HS) signal and a Vsync (VS) signal. These signals are processed by the TCON and converted into a data signal, a control signal (for example, STV, RST, etc.), and a clock signal (CLK) suitable for a data driving circuit and a scan driving circuit.

For example, the master chip is a central processing unit (CPU), a digital signal processor (DSP), and the like. For example, the input interface includes transistor transistor logic (TTL), transition minimized differential signaling (TMDS), low voltage differential signaling (LVDS), and the like. For example, the TCON is a timing control circuit.

Figure 2:
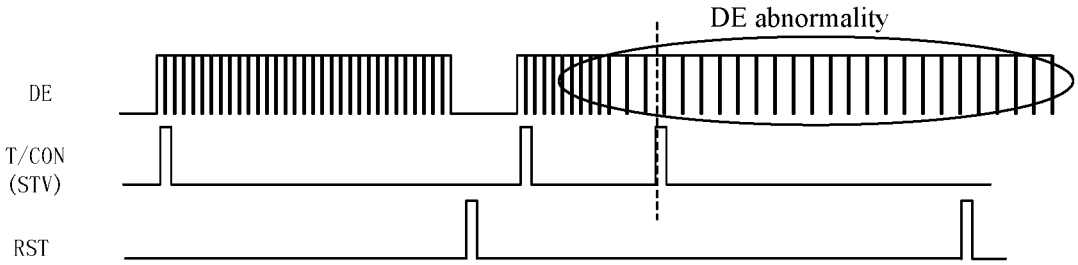
FIG. 2 is a timing signal diagram according to one technique.

FIG. 2 is a timing signal diagram according to one technique. As shown in FIG. 2, in a case where an abnormality occurs to a signal (for example, a DE signal) of the front-end system, the TCON responds to the abnormality in real time; the real-time response is manifested as that: the TCON immediately stops transmitting a timing signal of a current frame, and continues to respond to the signal of the front-end system to generate a new timing signal (e.g., a new STV signal). The above-described manner of the TCON responding to the abnormality of the signal of the front-end system in real time may result in abnormalities of some units of the display device (for example, disorder of the scan driving circuit, abnormality of a gate signal timing, abnormality of a data signal timing, etc.), so that display abnormality may occur, and the display is even impossible to return to normal.

Embodiments of the present disclosure provide that, in a case where the timing controller acquires the abnormality of the signal of the front-end system, the timing controller maintains a timing signal of a current frame to be complete, continues to transmit a normal timing signal until an end of the current frame, and controls the data driving circuit to transmit a last line of data before the timing controller acquires the abnormality of the signal of the front-end system to a display panel line-by-line or directly transmit a black picture to the display panel, until the end of the current frame. Therefore, timing signals output by the timing controller are all whole-frame timing signals, and it is ensured that no display abnormality occurs after the signal of the front-end system returns to normal.

Figure 3:
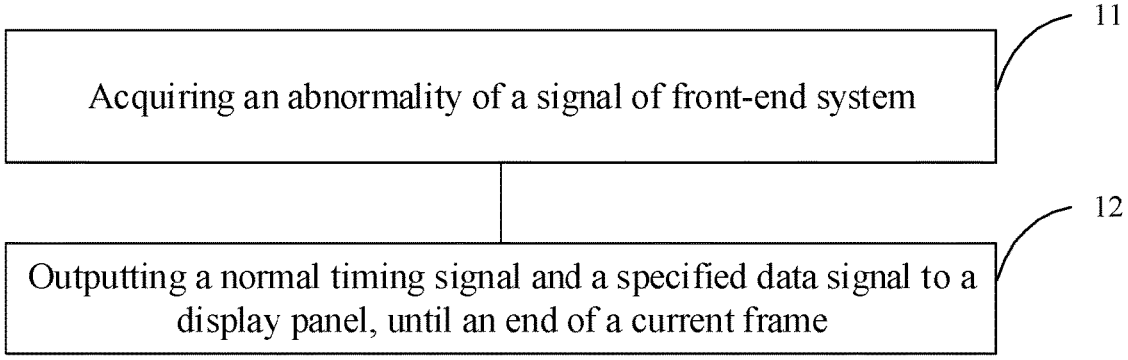
FIG. 3 is a flow chart of a display method of a display device according to embodiments of the present disclosure.

FIG. 3 is a flow chart of a display method of a display device according to the embodiments of the present disclosure. As shown in FIG. 3, the method according to the embodiments of the present disclosure comprises:

Step 11: acquiring the abnormality of the signal of the front-end system;

Step 12: outputting a normal timing signal and a specified data signal to the display panel, until an end of a current frame.

With reference to FIG. 1, for example, the display device comprises the display panel and a control circuit for transmitting a signal to the display panel, and the control circuit is indicated by a dot-and-dash line frame in FIG. 1. For example, the front-end system is a portion of the control circuit of the display device that is before the timing controller along a signal transmission direction; the signal of the front-end system is a signal from the front-end system. For example, with reference to FIG. 1, the front-end system includes the master chip and a portion (for example, an input interface) located between the master chip and the timing controller. In FIG. 2, the front-end system is indicated by a dot-line frame.

For example, both step 11 and step 12 are executed by the timing controller. That is, the method according to the embodiments of the present disclosure comprises: acquiring, by the timing controller, the abnormality of the signal of the front-end system; and outputting, by the timing controller, the normal timing signal and controlling, by the timing controller, the data driving circuit to output the specified data signal to the display panel, until the end of the current frame.

For example, the current frame is a frame being displayed when (i.e. just at the moment that) the timing controller acquires the abnormality of the signal of the front-end system. Therefore, the current frame is also referred to as an abnormal frame.

For example, the timing signal includes the STV signal, the CLK signal, the RST signal, and the like. For example, the normal timing signal is a timing signal of the current frame in a case where the abnormality does not occur to the signal of the front-end system. For example, the normal timing signal (i.e., the timing signal of the current frame in the case where the abnormality does not occur to the signal of the front-end system) coincides with a timing signal before the abnormality of the signal of the front-end system is acquired; more specifically, the normal timing signal coincides with the timing signal before the abnormality of the signal of the front-end system is acquired in all aspects, so that the normal timing signal is a continuation of the timing signal before the abnormality of the signal of the front-end system is acquired.

For example, the specified data signal is the last line of data before the timing controller acquires the abnormality of the signal of the front-end system or the black picture.

For example, before step 11, the method according to the embodiments of the present disclosure further comprises: starting to display the current frame.

For example, in step 12, the normal timing signal and the specified data signal are output, and besides, the response to the signal of the front-end system is stopped until the end of the current frame. That is, the timing controller stops responding to the signal transmitted by the front-end system until the end of the current frame.

Figure 4:
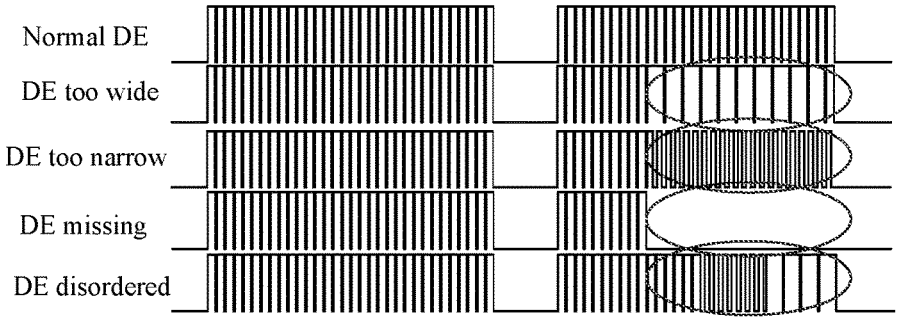
FIG. 4 is a schematic diagram of abnormalities of a data enable signal according to the embodiments of the present disclosure.

In the embodiments of the present disclosure, for example, the timing controller determines whether or not the abnormality occurs to the signal of the front-end system by analyzing a data enable (DE) signal. For example, as shown in FIG. 4, the abnormality of the data enable signal includes that: as compared with a preset data enable signal, a frequency of the data enable signal is larger or smaller, a pulse width of the data enable signal is larger or smaller, the data enable signal is missing, the frequency of the data enable signal is unstable, and the like. For example, the preset data enable signal is a normal data enable signal in a case where the signal of the front-end system is not abnormal (i.e., normal).

For example, the acquiring the abnormality of the signal of the front-end system includes: firstly, extracting, by the timing controller, the data enable signal from a signal (for example, a differential signal, such as an embedded display port (EDP) signal) output by the front-end system; then, comparing the extracted data enable signal, by a frequency analyzer device, with the preset data enable signal in frequency and/or pulse width. For example, if the data enable signal extracted by the timing controller is different from the preset data enable signal in frequency, or in pulse width, or in both frequency and pulse width, the data enable signal is considered abnormal and output to a data enable signal abnormality flag (flag1), that is, flag1=1 indicates that the data enable signal is abnormal. In a case where the data enable signal is abnormal, the timing controller stops responding to the front-end system, maintains the timing signal of the current frame to be complete, and transmits the specified data signal. For example, flag1=0 indicates that the data enable signal is normal. For example, the differential signal as described above is a signal transmitted from the front-end system to the timing controller, including RGB data, control signal, and other information (including a resolution, a refresh rate, a time point of activation, etc.).

In the embodiments of the present disclosure, once the timing controller acquires the abnormality of the signal of the front-end system, the timing controller automatically stops responding to the signal transmitted by the front-end system, outputs the normal timing signal and the specified data signal until the end of the current frame: and the specified data signal enables the display panel to display the black picture or other picture (for example, the last line of data before the timing controller acquires the abnormality of the signal of the front-end system is transmitted to the display panel line-by-line), to maintain the timing signal complete.

Figure 5:
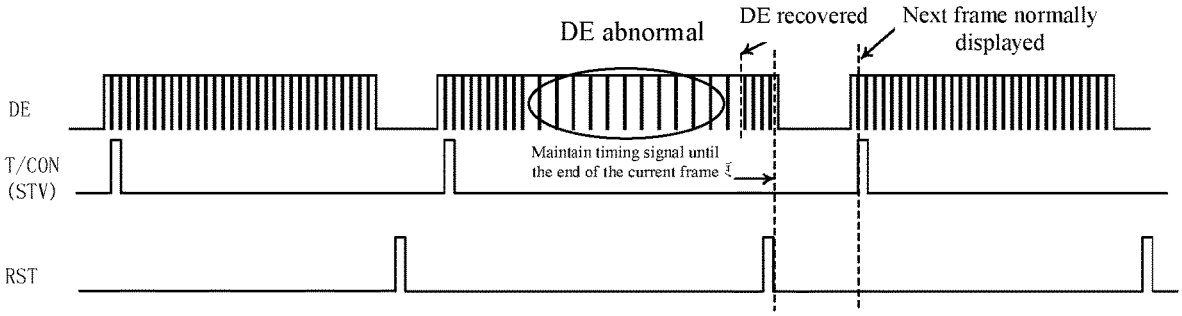
FIG. 5 is a timing signal diagram according to the embodiments of the present disclosure.

FIG. 5 is a timing signal diagram according to the embodiments of the present disclosure. As shown in FIG. 5, in a case where the abnormality occurs to the DE signal, the timing controller outputs and maintains the normal timing signal (for example, the STV signal) until the end of the current frame. For example, even if the DE signal returns to normal in the current frame, the timing controller still outputs and maintains the normal timing signal until the end of the current frame.

For example, in the method according to the embodiments of the present disclosure, in the case where the timing controller detects the abnormality of the signal of the front-end system, switching to a next mode (e.g., a fail mode) or returning to a normal mode is implemented after the end of the current frame (i.e., the abnormal frame), and thus it is ensured that no abnormality occurs after the signal of the front-end system returns to normal.

Figure 6:
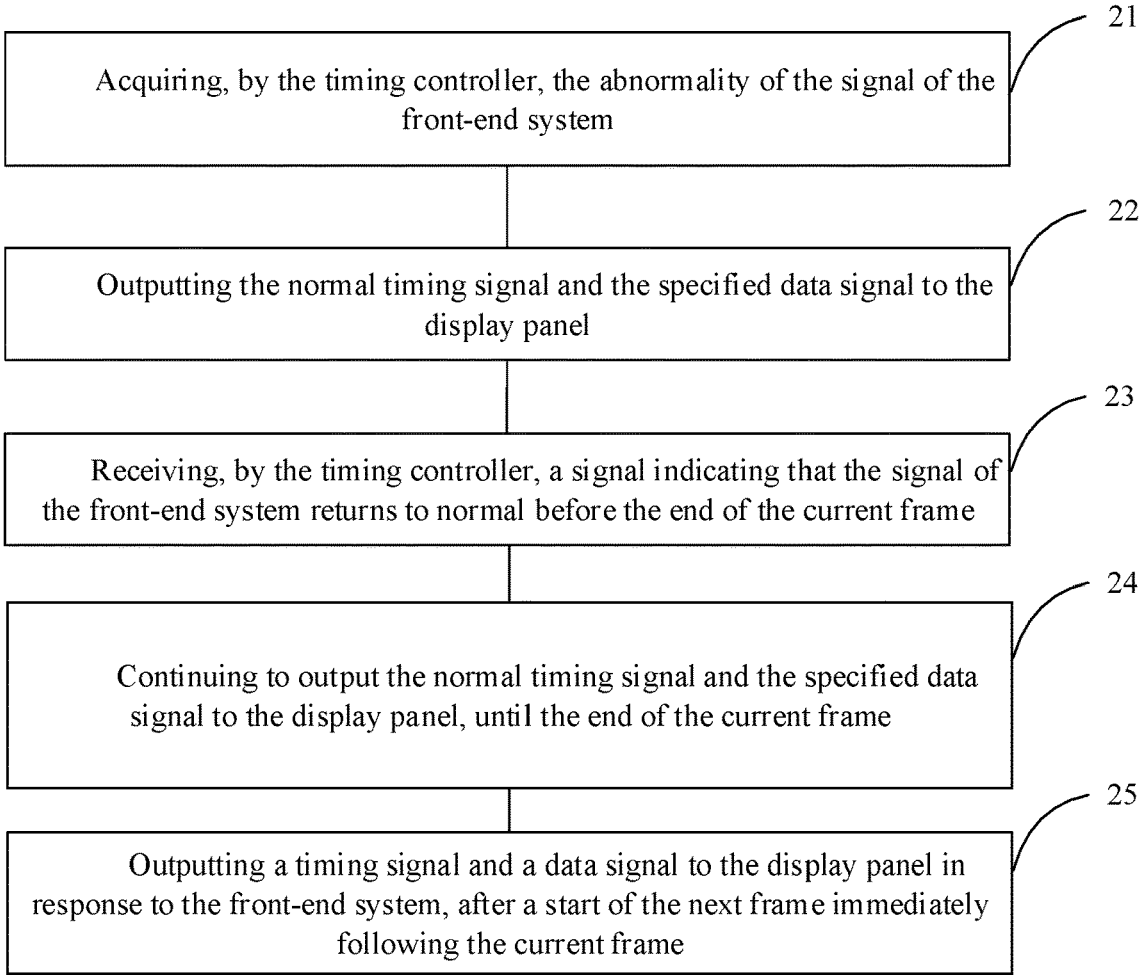
FIG. 6 is another flow chart of the display method of the display device according to the embodiments of the present disclosure.
Figure 7:
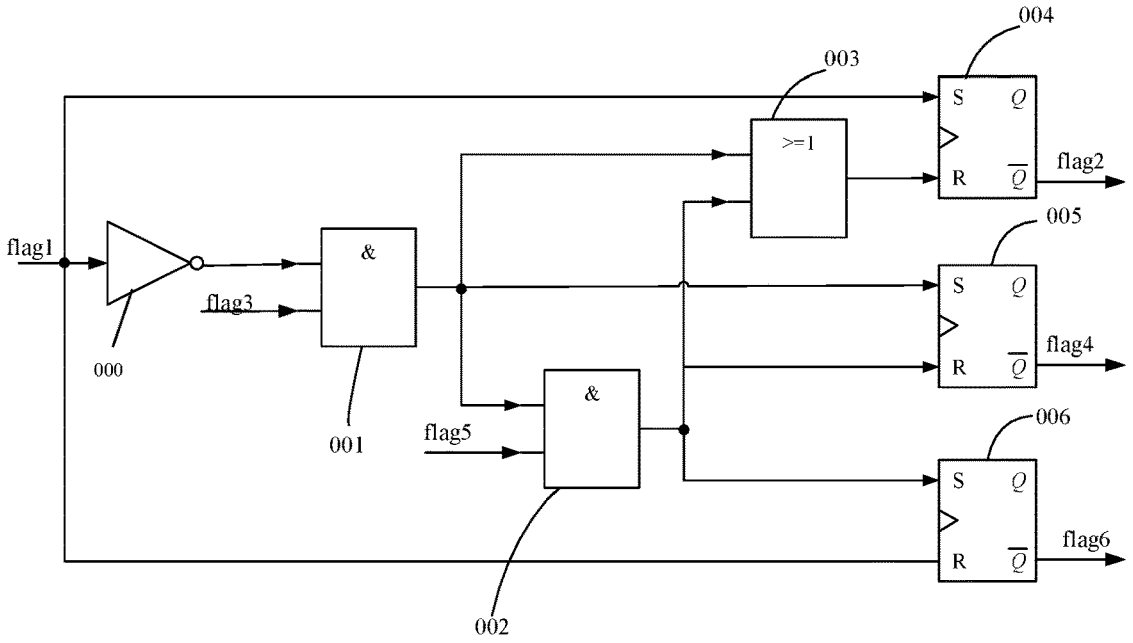
FIG. 7 is a logic schematic diagram of dealing with an abnormality of a signal of a front-end system according to the embodiments of the present disclosure.

FIG. 6 is another flow chart of the display method of the display device according to the embodiments of the present disclosure. FIG. 7 is a logic schematic diagram of dealing with the abnormality of the signal of the front-end system according to the embodiments of the present disclosure.

In FIG. 7, flag1 is the data enable signal abnormality flag, flag1=1 indicates that the abnormality occurs to the data enable signal; flag2 is an abnormal response flag bit, flag2=1 indicates that the front-end system signal is abnormal; flag3 is a frame end flag bit, the frame end flag bit is automatically recognized by the timing controller, flag31 indicates the end of the current frame; flag4 is an abnormality recovery preparation flag bit, flag4=1 indicates that the signal of the front-end system returns to normal; flag5 is a frame start flag bit, a state of the frame start flag bit is determined by reading start bit data transmitted by the front-end system to the timing controller, and flag5=1 indicates that the system starts transmitting current frame display data; flag6 is a normal display flag bit, and flag6=1 indicates that the front-end system signal is normal.

As shown in FIG. 6, the display method provided by the embodiments of the present disclosure comprises:

Step 21: acquiring, by the timing controller, the abnormality of the signal of the front-end system;

At this time, the data enable signal abnormality flag is flag1=1; since the current frame has not yet ended, the frame end flag bit is flag3=0. As shown in FIG. 7, NOT gate 000 has an output of 0, AND gate 001 has an output of 0, AND gate 002 has an output of 0, OR gate 003 has an output of 0, an RS controller 004 has an input end S=1, R=0, and an output Q=0, $\overline{Q}$ is output as the abnormality response flag bit flag2; and at this time, if flag2=1, it indicates that the front-end signal is abnormal. For example, the RS controller 004 has a logical relationship below: $Q^{n+1}=\overline{S}+R\cdot Q^{n}$.

Step 22: outputting the normal timing signal and the specified data signal to the display panel;

For example, in the step, the timing controller controls the data driving circuit to output the specified data signal to the display panel.

For example, in the step, the timing controller stops responding to the signal of the front-end system.

Step 23: receiving, by the timing controller, a signal indicating that the signal of the front-end system returns to normal before the end of the current frame;

The timing controller receives the signal indicating that the signal of the front-end system returns to normal, at this time, flag1=0, NOT gate 000 has the output of 1, and if flag3=1, AND gate 001 has an output of 1; since a next frame has not yet started, Flag5=0, AND gate 002 has the output of 0, OR gate 003 has the output of 1, and the RS controller 004 has the output flag2=0, which indicates that the front-end system is normal. An RS controller 005 has an input end S=1, R=0, the RS controller 005 has an output Q=0, and $\overline{Q}$ is output as an abnormality recovery preparation flag bit flag4, and at this time, if flag4=1, it indicates that the front-end system signal returns to normal, and the current display frame has ended, waiting for the next frame to start normal display.

Step 24: continuing to output the normal timing signal and the specified data signal to the display panel, until the end of the current frame;

That is to say, even if the front-end system signal returns to normal before the end of the current frame, the normal timing signal continues to be output to the display panel and the black picture data or other picture data continues to be transmitted to the display panel (for example, the timing controller controls the data driving circuit to transmit the last line of data before the timing controller acquires the abnormality of the signal of the front-end system to the display panel line-by-line), until the end of the current frame.

For example, in the step, the timing controller still stops responding to the front-end system.

Step 25: outputting a timing signal and a data signal to the display panel in response to the front-end system signal, after a start of the next frame immediately following the current frame.

That is, the abnormality recovery preparation flag bit is flag4=1, and if the frame start flag bit flag5=1, display of the entire system returns to normal, AND gate 002 has the output of 1, and an RS controller 006 has an input end S=1, R=0, and an output Q=0, $\overline{Q}$ is output as the normal display flag bit flag6, and at this time, flag6=1.

For example, in the step, the timing controller controls the data driving circuit to output the data signal to the display panel in response to the front-end system signal.

Figure 8:
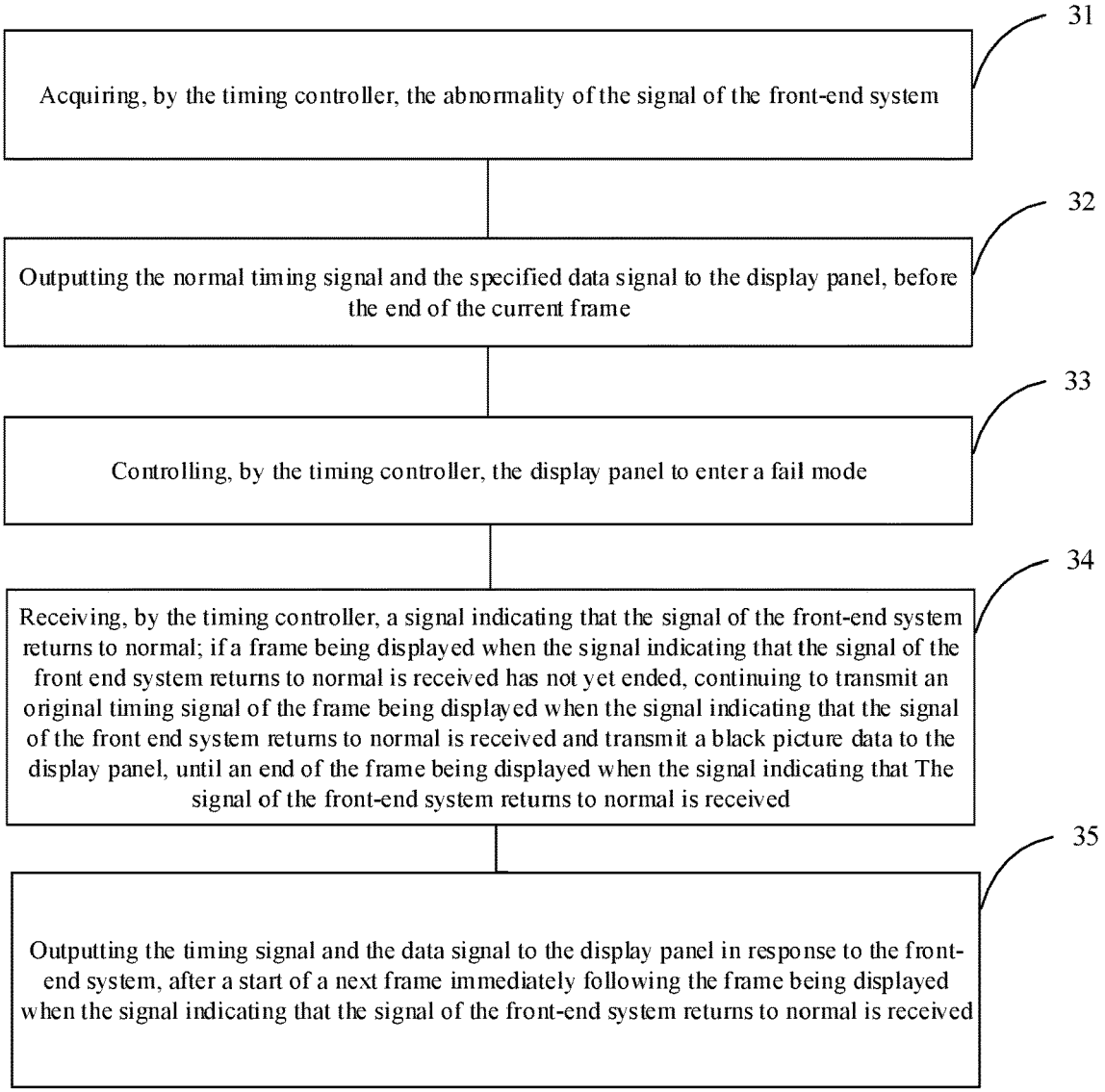
FIG. 8 is another flow chart of the display method of the display device according to the embodiments of the present disclosure.

FIG. 8 is another flow chart of the display method of the display device according to the embodiments of the present disclosure. As shown in FIG. 8, the method according to the embodiments of the present disclosure comprises:

Step 31: acquiring, by the timing controller, the abnormality of the signal of the front-end system;

Step 32: outputting the normal timing signal and the specified data signal to the display panel, before the end of the current frame;

For example, in the step, the timing controller controls the data driver to output the specified data signal to the display panel. For example, in the step, the timing controller stops responding to the signal of the front-end system.

Step 33: controlling, by the timing controller, the display panel to enter the fail mode, after the end of the current frame, that is, outputting, by the timing controller, an original timing signal of a frame after the current frame and outputting the black picture data;

For example, in the step, the timing controller still stops responding to the front-end system.

For example, the frame after the current frame is one frame, two frames, or more than two frames.

For example, the original timing signal of the frame after the current frame is a timing signal of the frame after the current frame in a case where the front-end system signal is not abnormal (i.e., is normal). In a case where the number of frames after the current frame is two or more, each frame has its own original timing signal, and original timing signals of respective frames may be identical to or different from one another.

For example, the normal timing signal of the current frame may be identical to or different from the original timing signal of the frame after the current frame.

For example, in the step, the timing controller controls the data driving circuit to output the black picture data to the display panel.

Step 34: receiving, by the timing controller, the signal indicating that the signal of the front-end system returns to normal; if a frame being displayed when the signal indicating that the signal of the front-end system returns to normal is received has not yet ended, continuing to transmit the original timing signal of the frame being displayed when the signal indicating that the signal of the front-end system returns to normal is received and transmit the black picture data to the display panel, until an end of the frame being displayed when the signal indicating that the signal of the front-end system returns to normal is received;

For example, in the step, the timing controller still stops responding to the front-end system.

Step 35: outputting the timing signal and the data signal to the display panel in response to the front-end system, after a start of a next frame immediately following the frame being displayed when the signal indicating that the signal of the front-end system returns to normal is received.

For example, in the step, the timing controller controls the data driving circuit to output the data signal to the display panel in response to the front-end system.

It should be noted that, in a case where display of one frame just ends or display of one frame just starts when the signal indicating that the front-end system signal returns to normal is received, the timing signal and the data signal are output to the display panel in response to the front-end system signal.

The display method according to the embodiments of the present disclosure ensures that timing signals transmitted by the timing controller are all whole-frame timing signals, and in this way, no timing signal disorder occurs to the display panel.

Figure 9:
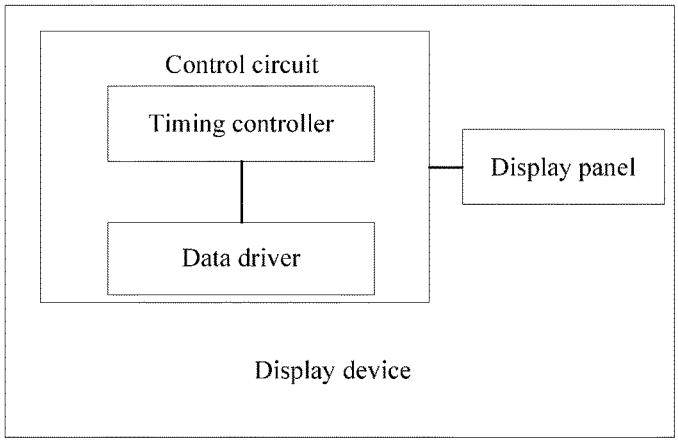
FIG. 9 is a schematic diagram of a display device according to the embodiments of the present disclosure.

FIG. 9 is a schematic diagram of a display device according to the embodiments of the present disclosure. As shown in FIG. 9, the display device according to the embodiments of the present disclosure comprises: a display panel and a control circuit for transmitting a signal to the display panel, the control circuit includes a timing controller and a data driver. For example, the timing controller is a timing control circuit, and the data driver is a data control circuit.

For example, the timing controller is configured to acquire an abnormality of a signal of a front-end system, and output a normal timing signal and a specified data signal until an end of a current frame.

For example, the timing controller controls the data driver to output the specified data signal to the display panel until the end of the current frame.

For example, with respect to the display panel according to the embodiments of the present disclosure, in a case where the timing controller acquires the abnormality of the signal of the front-end system, switching to a next mode, e.g., a fail mode, or returning to a normal mode is performed after the end of the current frame (i.e., an abnormal frame), and thus it is ensured that no abnormality occurs after the signal of the front-end system returns to normal.

For example, in a case where a signal indicating that the signal of the front-end system returns to normal is received before the end of the current frame, the timing controller still outputs the normal timing signal and still controls the data driver to output the specified data signal to the display panel until the end of the current frame. Further, for example, after the end of the current frame, the timing controller outputs a timing signal and controls the data driver to output a data signal to the display panel in response to the front-end system.

For example, in a case where the signal indicating that the signal of the front-end system returns to normal is not received after the end of the current frame, the timing controller controls the display panel to enter the fail mode, that is, the timing controller transmits an original timing signal of a frame after the current frame and controls the data driver to transmit a black picture data to the display panel.

For example, after the display panel enters the fail mode, in a case where the signal indicating that the signal of the front-end system returns to normal is received, the timing controller, in response to the front-end system, outputs the timing signal and controls the data driver to output the data signal to the display panel after an end of the frame being displayed when the signal indicating that the signal of the front-end system returns to normal is received.

For example, the timing controller determines whether or not the signal of the front-end system is abnormal by analyzing the data enable signal. For example, the abnormality of the signal of the front-end system includes any one of cases where: as compared with a preset data enable signal, a frequency of the data enable signal is larger or smaller, a pulse width of the data enable signal is larger or smaller, the data enable signal is missing, and the frequency of the data enable signal is unstable.

According to the embodiments of the present disclosure, in a case where the timing controller detects that the signal of the front-end system is abnormal, the timing controller maintains the timing signal of the current frame complete, continues to transmit the normal timing signal until the end of the current frame, and controls the data driving circuit to transmit the last line of data before the timing controller detects the abnormality of the signal of the front-end system or directly transmit the black picture to the display panel until the end of the current frame. Thus, timing signals output by the timing controller are all whole-frame timing signals, and it is ensured that no display abnormality occurs after the front-end system signal returns to normal. Therefore, display abnormality or malfunction due to the abnormality of the signal of the front-end system is avoided.

Those ordinarily skilled in the art should understand that all or part of the steps in the display method according to the embodiments of the present disclosure may be completed by a program to instruct related hardware, and the program may be stored in a computer readable storage medium, for example, a read only memory, a magnetic disk or an optical disk, and the like. For example, all or part of the steps in the display method according to the embodiments of the present disclosure may be implemented with one or more integrated circuits. Correspondingly, respective modules/units of the device according to the embodiments of the present disclosure may be implemented in a form of hardware, or may also be implemented in a form of a software functional module. The embodiments of the present disclosure are not limited to any particular form of hardware, software, or a combination of hardware and software. For example, the timing controller is the timing control circuit, and the data driver is the data driving circuit.

The foregoing embodiments merely are exemplary embodiments of the present disclosure, and not intended to define the scope of the present disclosure, and the scope of the present disclosure is determined by the appended claims.

The invention claimed is:

1. A display method of a display device, the display device comprising a display panel, wherein, the method comprises:

acquiring an abnormality of a signal of a front-end system;

outputting a normal timing signal and a specified data signal to the display panel, until an end of a current frame, wherein, the current frame is a frame being displayed when the abnormality of the signal of the front-end system is acquired, and the normal timing signal is a timing signal of the current frame in a case where the abnormality does not occur to the signal of the front-end system; and in a case where a signal indicating that the signal of the front-end system returns to normal is received before the end of the current frame, continuing to output the normal timing signal and the specified data signal to the display panel until the end of the current frame.

2. The display method according to claim 1, comprising:

outputting a timing signal and a data signal to the display panel in response to the signal of the front-end system after the end of the current frame.

3. The display method according to claim 1, comprising:

in a case where a signal indicating that the signal of the front-end system returns to normal is not received after the end of the current frame, entering a fail mode.

4. The display method according to claim 3, comprising:

after entering the fail mode, in a case where the signal indicating that the signal of the front-end system returns to normal is received, outputting a timing signal and a data signal to the display panel in response to the signal of the front-end system after an end of a frame being displayed when the signal indicating that the signal of the front-end system returns to normal is received.

5. The display method according to claim 3, comprising:

outputting an original timing signal of a frame after the current frame and outputting a black picture data to the display panel, in the fail mode, wherein, the original timing signal of the frame after the current frame is a timing signal of the frame after the current frame in the case where the abnormality does not occur to the signal of the front-end system.

6. The display method according to claim 1, wherein, the acquiring the abnormality of the signal of the front-end system includes: analyzing a data enable signal, to determine whether or not the signal of the front-end system is abnormal.

7. The display method according to claim 6, wherein, the abnormality of the signal of the front-end system includes any one of cases where: as compared with a preset data enable signal, a frequency of the data enable signal is larger, the frequency of the data enable signal is smaller, a pulse width of the data enable signal is larger, the pulse width of the data enable signal is smaller, the data enable signal is missing, and the frequency of the data enable signal is unstable.

8. The display method according to claim 1, wherein, the specified data signal is a last line of data before the abnormality of the signal of the front-end system is acquired or a black picture data.

9. The display method according to claim 1, wherein, the display device comprises a control circuit for transmitting a signal to the display panel, the control circuit includes a timing controller, and the front-end system is a portion of the control circuit that is before the timing controller along a signal transmission direction.

10. A display device, comprising a display panel and a control circuit for transmitting a signal to the display panel, the control circuit including a timing controller and a data driver, wherein, the timing controller is configured to acquire an abnormality of a signal of a front-end system, and output a normal timing signal and controls the data driver to output a specified data signal to the display panel until an end of a current frame;

the current frame is a frame being displayed when the abnormality of the signal of the front-end system is acquired, and the normal timing signal is a timing signal of the current frame in a case where the abnormality does not occur to the signal of the front-end system, wherein, in a case where a signal indicating that the signal of the front-end system returns to normal is received before the end of the current frame, the timing controller continues to output the normal timing signal and continues to control the data driver to output the specified data signal to the display panel until the end of the current frame.

11. The display device according to claim 10, wherein, after the end of the current frame, the timing controller outputs a timing signal and controls the data driver to output a data signal to the display panel in response to the front-end system signal.

12. The display device according to claim 10, wherein, the timing controller acquires the abnormality of the signal of the front-end system by analyzing a data enable signal.

13. The display device according to a claim 12, wherein, the abnormality of the signal of the front-end system includes any one of cases where: as compared with a preset data enable signal, a frequency of the data enable signal is larger, the frequency of the data enable signal is smaller, a pulse width of the data enable signal is larger, the pulse width of the data enable signal is smaller, the data enable signal is missing, and the frequency of the data enable signal is unstable.

14. The display device according to claim 10, wherein, the specified data signal is a last line of data before the abnormality of the signal of the front-end system is acquired or a black picture data.

15. The display device according to claim 10, wherein, the front-end system being a portion of the control circuit that is before the timing controller along a signal transmission direction.

16. A display device, comprising a display panel and a control circuit for transmitting a signal to the display panel, the control circuit including a timing controller and a data driver, wherein, the timing controller is configured to acquire an abnormality of a signal of a front-end system, and output a normal timing signal and controls the data driver to output a specified data signal to the display panel until an end of a current frame;

the current frame is a frame being displayed when the abnormality of the signal of the front-end system is acquired, and the normal timing signal is a timing signal of the current frame in a case where the abnormality does not occur to the signal of the front-end system, wherein, in a case where a signal indicating that the signal of the front-end system returns to normal is not received after the end of the current frame, the timing controller controls the display panel to enter a fail mode, and, after the display panel enters the fail mode, in a case where the signal indicating that the signal of the front-end system returns to normal is received, the timing controller outputs a timing signal and controls the data driver to output a data signal to the display panel in response to the signal of the front-end system after an end of a frame being displayed when the signal indicating that the signal of the front-end system returns to normal is received.

17. The display device according to claim 16, wherein, in the fail mode, the timing controller outputs an original timing signal of a frame after the current frame and controls the data driver to output a black picture data to the display panel, the original timing signal of the frame after the current frame is a timing signal of the frame after the current frame in the case where the abnormality does not occur to the signal of the front-end system.

* * * * *